United States Patent [19]

Coccia

[11] 4,257,485

[45] Mar. 24, 1981

[54] SPONGE IRON STORAGE HOPPER HAVING A SENSOR AND AN INERT GAS SUPPLY

[75] Inventor: Larry A. Coccia, Elizabeth, Pa.

[73] Assignee: Pullman Incorporated, Chicago, Ill.

[21] Appl. No.: 86,550

[22] Filed: Oct. 19, 1979

[51] Int. Cl.[3] ..... A62C 37/04

[52] U.S. Cl. ..... 169/61; 73/375; 169/11; 169/68

[58] Field of Search ..... 169/11, 12, 45, 60, 169/61, 64, 66, 68, 69; 73/343 R, 371, 372, 373, 374, 375, 376, 377, 378

[56] References Cited

U.S. PATENT DOCUMENTS

| | | | |
|---|---|---|---|
| 2,156,826 | 5/1939 | Ullman | 73/362.8 |
| 2,706,527 | 4/1955 | Guljas et al. | 169/68 X |
| 3,779,078 | 12/1973 | Kaesser et al. | 73/343 R |
| 3,831,318 | 8/1974 | Richmond | 169/45 X |
| 3,902,368 | 9/1975 | Hasenbein et al. | 73/343 R |
| 4,047,571 | 9/1977 | Chantrier et al. | 169/60 |
| 4,082,148 | 4/1978 | Willms | 169/61 |
| 4,088,193 | 5/1978 | Colgate | 169/45 |

*Primary Examiner*—Stanley H. Tollberg
*Assistant Examiner*—Fred A. Silverberg
*Attorney, Agent, or Firm*—Richard J. Myers; Paul A. Kerstein; Stephen D. Geimer

[57] ABSTRACT

Sponge iron pellets resulting from gaseous direct reduction of iron ore are stored in bins which include heat monitoring devices which activate at a predetermined temperature, an inert gas supply that distributes cooling fluid into the bins to provide for cooling of the same.

10 Claims, 7 Drawing Figures

SPONGE IRON STORAGE HOPPER HAVING A SENSOR AND AN INERT GAS SUPPLY

BACKGROUND OF THE INVENTION

1. Field of the Invention

The present invention relates to storage bins for storing sponge iron after it has been manufactured by a direct reduction process. More specifically it relates to a sponge iron storage container which in the event of certain predetermined conditions provides for cooling of the material contained therein.

2. Description of the Prior Art

U.S. Pat. No. 4,047,571 issued Sept. 13, 1977 discloses an automatic fire extinguishing system which is activated by a fire detector. An air conditioning system is used to distribute foam throughout the building.

U.S. Pat. No. 4,088,193 patented May 9, 1978 discloses a system where explosion is prevented in the hold of a ship containing a compound which is incompatible with water. Inert gas would form a blanket preventing such explosion.

The present invention is a patentable improvement over the prior art in that a unique and specific construction is provided to control the temperature of sponge iron pellets by the introduction of a cooling gas.

SUMMARY OF THE INVENTION

A storage bin for sponge iron as it leaves a reduction reactor includes a plurality of vertically extending pipes suspended within the bin. Each pipe is provided with a vertical groove containing a sensor means in the form of a capillary tube suitably connected to a temperature responsive means. The tube is protected by means of a metal shield extending the length of the groove.

The lower end of the vertical pipes are supported on transversely extending inert gas pipes which project outwardly from the bins and are connected to electrically controlled valves leading to a source of inert gas. In the event that the pellets of sponge iron overheat the temperature responsive means, a signal from the capillary tube actuates the valves permitting inert gas to enter into the bin for cooling the iron pellets.

DESCRIPTION OF THE PREFERRED EMBODIMENT

Figure 1:
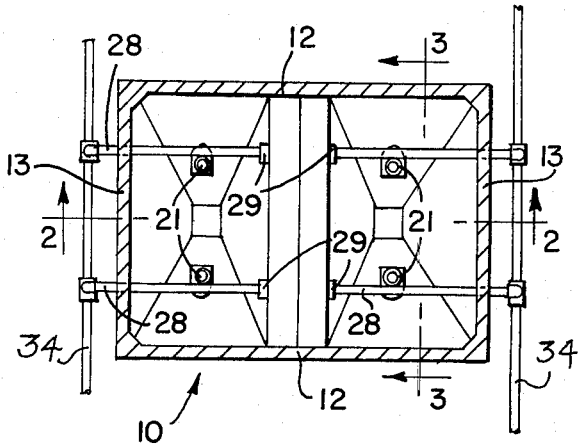
FIG. 1 is a cross-sectional view of a bin including temperature sensors.
Figure 2:
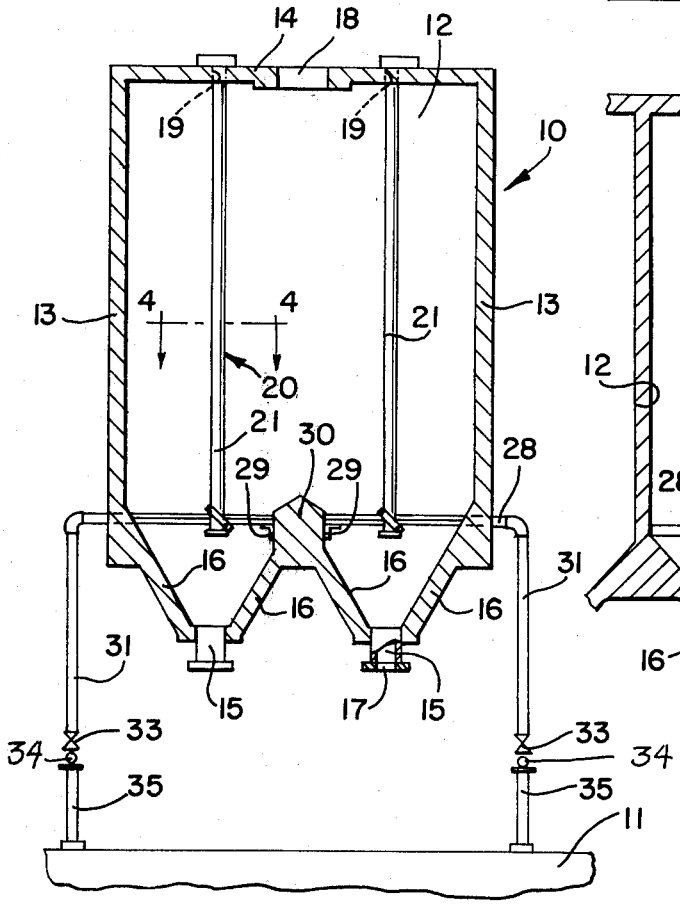
FIG. 2 is a cross-sectional view of the bin taken along line 2—2 of FIG. 1.
Figure 3:
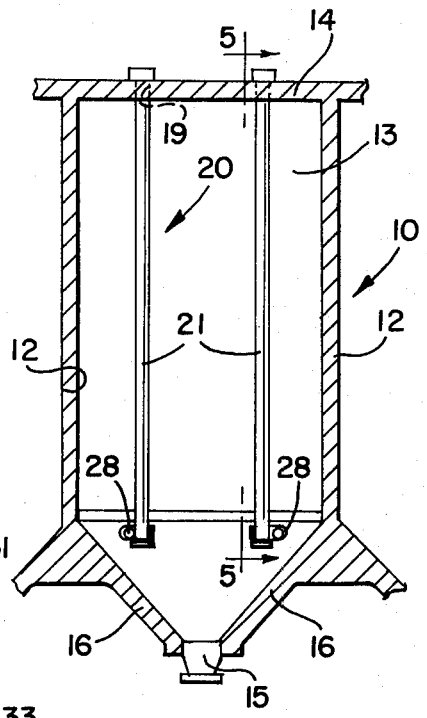
FIG. 3 is a cross-sectional view of the bin taken along line 3—3 of FIG. 2.
Figure 4:
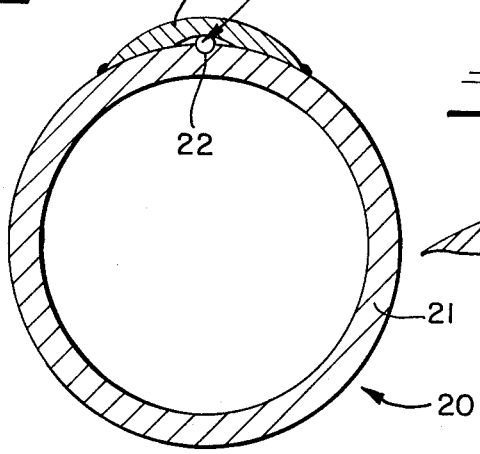
FIG. 4 is a cross-sectional view of a sensor pipe taken along line 4—4 of FIG. 2.
Figure 7:
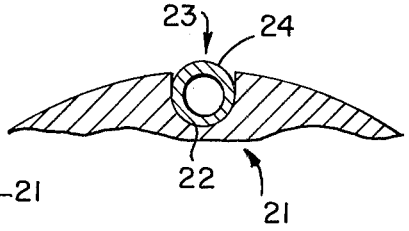
FIG. 7 is an enlarged detail sectional view of a sensor means.

FIG. 1 is a plan view of a storage bin 10 which is adapted to store particulate matter such as sponge iron pellets. A plurality of such bins may be provided near a direct reduction vessel. As best shown in FIG. 2 the bins 10 are mounted above ground level on supports 11. The bins 10 have vertically extending walls 12 and 13, a roof 14, and outlet gates 15 for unloading the stored material. The outlet gates 15 are connected to sloped wall hopper portions 16 adapted to direct the material toward openings 17 located proximate the lower part of the outlet gates 15.

The roof 14 includes an opening 18 through which the particulate material is poured into the bin 10. As best shown in FIGS. 1 and 2, a roof 14 also includes openings 19 through which a sensor structure 20 extends. The sensor structure 20 includes a vertically extending pipe 21 having a vertical groove or slot portion 22 extending the length of the pipe 21. Temperature sensing means 23 such as a capillary tube 24 is located in each slot 22. A shield 25 covers the sensing means 23 to protect it from the stored sponge iron material within the bin 10.

Figure 5:
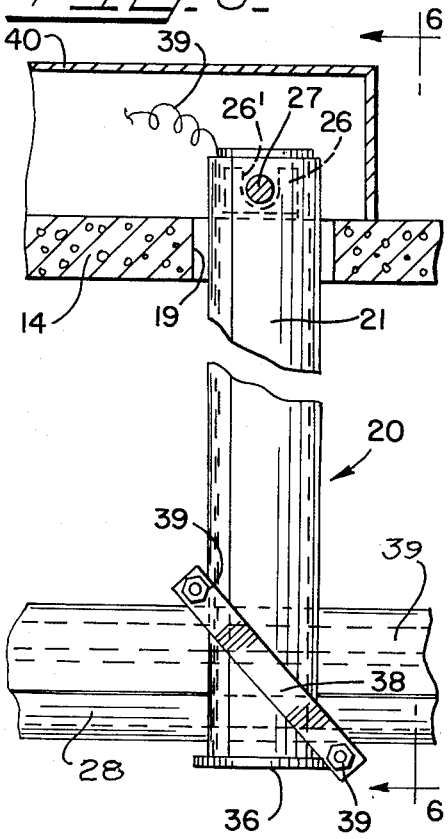
FIG. 5 is a view taken substantially along the line 5—5 of FIG. 3.
Figure 6:
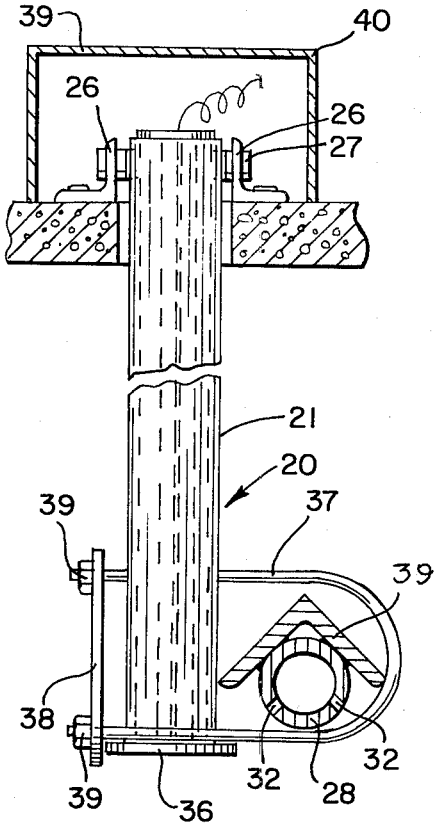
FIG. 6 is a view along line 6—6 of FIG. 5.

As best shown in FIGS. 5 and 6, a sensor structure mounting means include a pair of angle brackets 26 connected to the roof 14 on each side of each opening 19. A shaft 27 extends through the sensor pipe 21. The angle brackets 26 include recesses or slots 26' which cradle a shaft 27. Thus the sensor pipe 21 is pivotally mounted from the roof on the angle brackets 26. The openings 19 are larger than the diameter of the pipe thus allowing limited lateral movement of the pipe. This allows the pipe to move slightly during loading and unloading of the stored material.

As is best shown in FIG. 1, there are four sensor pipes for each bin 10 and each bin has two outlet gates 15. The temperature sensor structure 20 is capable of detecting increases in temperature at any point along the length of the pipe. This is especially important in the storage of sponge iron since it is dumped into the bin at a temperature of 100° F. or more. Spontaneous combustion can occur at any point and the temperature rise caused by such combustion must be detected. If it is not detected the sponge iron can reach the melting point and fuse together.

Inert gas supply means are utilized to supply inert gas such as $N_2$ to the bin in the event that the material in the bin starts to heat up and go above the predetermined temperature. The inert gas supply means includes gas discharge pipes 28 mounted on support brackets 29 carried by a central beam 30 dividing the two outlet gates 15. Gas supply conduits 31 extend downwardly from the gas discharge pipes 28. An electrically controlled valve 33 is provided for each conduit 31 and controls the flow of gas into the bin. Gas supply conduits 34 are operably connected to valves 33 and pipes 35 are in communication with a source of inert gas not shown. The gas discharge pipes 28 extend through the walls 13 of the bin and terminate at the central beam or wall 30, as best shown in FIG. 2. The brackets 29 support the free ends of the conduits 31.

As best shown in FIGS. 5 and 6, the sensor pipes 21 are suspended from the roof 14 and at their lower ends are provided with closure caps 36. The gas supply conduits 34 are also supported by the pipes 21 by means of U-shaped hanger bolts 37, connector plates 38 and nuts 39 which rigidly connect the parts together. One leg of the U-bolt 37 is supported on the closer cap 36. An angle iron shield or hood 39' is suitably rigidly connected to the top of each pipe 28 to protect the same and to deflect stored material sideways and prevent the same from packing around the outlets.

As best shown in FIG. 6, the inert gas supply pipe 28 has a plurality of gas outlet holes 32 along the length of the pipe. The holes 32 are downwardly directed and located below the center line of the pipe.

As best shown in FIGS. 5 and 6 a suitable electric connector 39'' is enclosed within a box 40 mounted on the roof 14. The connector 39'' connects the capillary tube 24 to a suitable electrical control means (not shown) in conventional fashion which in turn operates the valves 33 to provide inert cooling gas to the bins when excessive temperatures occur within the bins. Capillary type electrical control devices are conventional in the art as disclosed in U.S. Pat. No. 2,156,826, May 2, 1939 and U.S. Pat. No. 3,779,078, Dec. 18, 1973. Thus during storage when the products within the bin become too hot and damage could occur the capillary sensor means provides for inert gas cooling until the proper temperature is obtained.

As best shown in FIG. 1, the conduits 28 are supported on walls 13 and supports 29. Since the sensor pipes 21 are pivotally supported at their upper ends, and the connection furnished by the U-bolt at the lower end permits a limited amount of sideway movement, it accommodates the stresses encountered during loading and unloading of the sponge iron pellets.

What is claimed is:

1. In a storage bin having upright walls, a roof and lower discharge outlets, the improvement of temperature sensor and cooling means comprising;

a sensor support means within said bin, a sensor means connected to said sensor support means, said sensor means extending substantially the vertical extent of said bin, and inert gas supply means within said bin, said inert gas supply means being operably connected to said sensor means and being adapted to supply inert gas to said bin upon a predetermined rise in temperature within said bin.

2. The invention in accordance with claim 1, said sensor support means including an elongated member pivotally mounted on said roof for limited swinging movement and, said sensor means comprising a capillary temperature sensing tube carried on said elongated member and being substantially coextensive lengthwise therewith.

3. The invention in accordance with claim 2, said elongated member comprising a pipe having an elongated vertically extending recess and said capillary tube being contained within said recess.

4. The invention in accordance with claim 2, said elongated member including protective shielding means for said tube.

5. The invention in accordance with claim 2, said elongated member including an elongated groove, said tube being enclosed within said groove.

6. The invention in accordance with claim 5, said gas supply means including a horizontal pipe extending within said bin and being connected to a source of inert gas, means connecting said pipe to a lower portion of said elongated member, and means connecting said pipe to said bin structure, said elongated member having limited horizontal swinging movement relative to said horizontal pipe.

7. The invention in accordance with claim 6, including a shielding member supported on said horizontal pipe.

8. The invention in accordance with claim 1, said gas supply means including conduit means supported on the lower portion of said sensor means.

9. The invention in accordance with claim 8, said inert gas supply means comprising a substantially horizontal pipe operably connected to an inert gas supply.

10. The invention in accordance with claim 9, including valve means on said inert gas supply means responsive to said sensor means for supplying gas to said bin during a predetermined temperature within said bin.

* * * * *